United States Patent [19]

Hirvi

[11] Patent Number: 4,836,000

[45] Date of Patent: Jun. 6, 1989

[54] LEVER TUMBLER LOCK

[75] Inventor: Jorma Hirvi, Eskilstuna, Sweden

[73] Assignee: AB Fas Lasfabrik, Eskilstuna, Sweden

[21] Appl. No.: 199,669

[22] Filed: May 26, 1988

[30] Foreign Application Priority Data

Jun. 23, 1987 [SE] Sweden ..... 8702599

[51] Int. Cl.[4] ..... E05B 25/02

[52] U.S. Cl. ..... 70/352; 70/394

[58] Field of Search ..... 70/352, 376, 377, 350, 70/355, 353, 354, 392, 394

[56] References Cited

U.S. PATENT DOCUMENTS

| | | | |
|---|---|---|---|
| 108,770 | 11/1870 | Dickerman | 70/352 |
| 246,605 | 9/1881 | Egge | 70/355 |
| 4,400,956 | 8/1983 | Martin | 70/394 |

FOREIGN PATENT DOCUMENTS 448248 2/1987 Sweden .

*Primary Examiner*—Lloyd A. Gall

*Attorney, Agent, or Firm*—Young & Thompson

[57] ABSTRACT

The present invention relates to a lever tumbler lock in which the scrape marks caused by the key bit as it displaces the various tumblers will not be completely informative of the configuration of the key bit.

According to the invention the lock includes a device which as a key bit (13) inserted into the lock housing (1) is turned will scrape against at least a part of the cam surface (10) of at least one tumbler (2) such as to create on this cam surface or those cam surfaces scrape marks which cover the scrape marks caused by corresponding cams on the key bit when the key is turned, at least at the beginning and the end of these scrape marks.

7 Claims, 2 Drawing Sheets

LEVER TUMBLER LOCK

BACKGROUND OF THE INVENTION

The present invention relates to a lever tumbler lock of the kind in which the scrape marks created by the key bit as it displaces the various tumblers will not reveal completely the configuration of the key bit, these scrape marks being readable with the aid of fibre optics.

A tumbler lock of this kind is known from SE-B-8601831-4. By the arrangement of special recesses in the ends of the camming surfaces of respective tumblers, the scrape marks created by rotation of the key bit on the tumbler camming surfaces for some cam holders can be caused to start and finish at mutually the same locations on respective cam surfaces. This means that such scrape marks will no longer reveal information as to the construction of corresponding parts of the key bit. Due to the abutment of the side surfaces of the key bit with the cam surfaces, this particular lock construction results in the application of relatively large lateral forces on certain of the tumblers, which subject the tumbler guide pins to load and therewith render the key more difficult to turn than in the case of conventional tumbler lock construction.

SUMMARY OF THE INVENTION

The object of the present invention is to provide a lever tumbler lock of the aforesaid kind in which occurrent lateral forces are not greater than those experienced in conventional lever tumbler locks.

This object is achieved with a lever tumbler lock constructed in accordance with the invention and having the characteristic features set forth in claim 1. Owing to the fact that no increase occurs in the lateral forces on the tumbler guide pins in relation to conventional locks, the useful life of the lock will be extended beyond that of the lock taught by the aforesaid Swedish Patent Specification. Furthermore, the invention scraping devices can be incorporated in conventional locks without requiring significant modification to the lock components. In addition hereto, the invention in combination with tumblers which have the configuration taught by said Swedish Patent Specification renders it impossible to glean any information whatsoever with regard to the configuration of a key bit, by reading the scrape marks created on the cam surfaces of the tumblers.

BRIEF DESCRIPTION OF THE DRAWING

These and other advantages afforded by the invention will be more apparent from the following description of a preferred embodiment of an inventive lever tumbler lock illustrated in the accompanying drawings, in which.

DESCRIPTION OF THE PREFERRED EMBODIMENT

Figure 1:
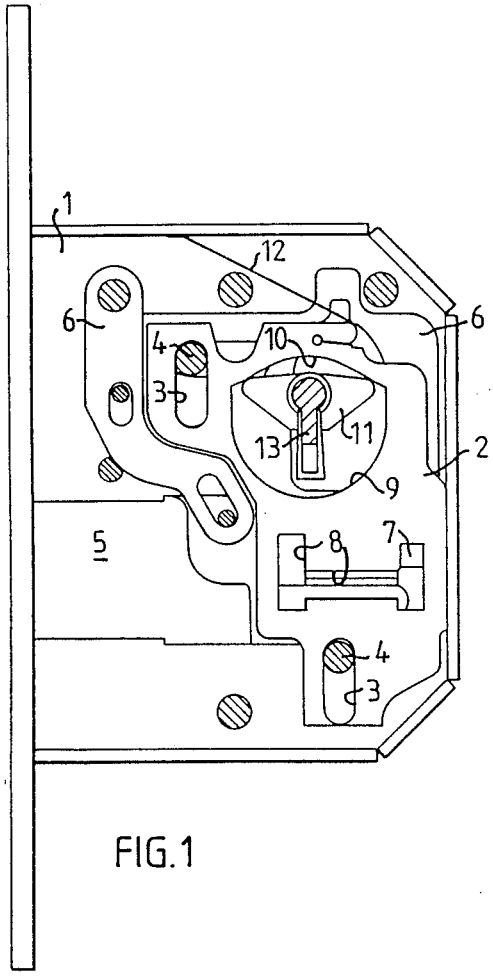
FIG. 1 is a front, cross-sectional view of a lever tumbler lock constructed in accordance with the invention.
Figure 2:
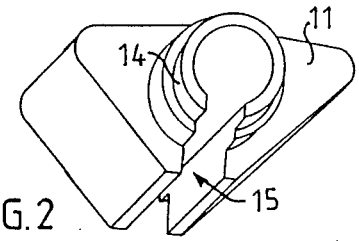
FIG. 2 illustrates in perspective a scraping device forming part of the lock shown in FIG. 1.

FIG. 1 illustrates the invention lever tumbler lock with the front cover of the lock housing 1 removed.

The lock housing has arranged therein a plurality of tumblers 2 which can be displaced through guide slots 3 onto guide pins 4 which project from the bottom of the housing. A bolt 5 can be moved linearly, via a link mechanism 6, between an open and a locking position, i.e. between a position in which the bolt is located totally within the housing and a position in which a part of the bolt projects out of the housing. A stop in 7 co-acts with a U-shaped channel 8 in each tumbler, so that the bolt can only be displaced when the stop pin 7 is located opposite the horizontal part (FIG. 1) of the channel of all tumblers. Each tumbler also incorporates in the region of the keyhole formed in the lock base a cut-out 9, the upper part of which forms a cam surface 10 for co-action with a key bit 13, in a manner hereinafter described. Finally, a leaf spring 12 is connected to each tumbler and biasses the tumblers towards the position shown in FIG. 1. The lock components described hitherto are similar to those found in conventional lever tumbler locks, and consequently a detailed description of the function of these components and their particular geometry is not necessary in order to obtain an understanding of the invention.

In accordance with the invention a scraping device 11 is journalled in the lock housing within the confines of the tumbler cut-outs 9. The scraping device comprises a triangular twist-sleeve the width of which corresponds to the total width of the tumblers together with any distance pieces that may be located therebetween. The twist-sleeve has provided at both ends thereof annular trunnions 14 which co-act with respective bearing recesses in the lock cover plate and the lock base plate such as to rotatably mount the twist-sleeve in the housing. The inner surfaces of the trunnions form the end parts of a keyhole-shaped through-passing channel 15 of the twist-sleeve, and the trunnion which co-acts with the lock base plate thus defines the upper part of the lock keyhole. It is mentioned in this regard that the only alterations which need be made to existing locks or keys in order to apply the present invention reside in a slight modification to the tumbler and in either making the upper part of the keyhole larger so that the twist-sleeve can be journalled, or reducing the size of the upper part of the key, so that the key can be inserted into a smaller keyhole. As will be seen from the figures, the twist-sleeve has the general shape of an isosceles triangle and is positioned so that the base surface of the twist-sleeve will face the cam surfaces 10 of respective tumblers when the key is inserted, i.e. such that the keyhole-shaped channel 15 opens into the apex of the triangle. The scraping device is thus configured to ensure that the key can always be inserted into the lock when the base surface of the triangular twist-sleeve faces the cam surfaces of respective tumblers.

The function of the lock will now be described with reference to FIGS. 3A–3F which illustrate schematically the mutual relationships between respective tumblers, which are represented solely by their respective cut-outs 9, and the key bit 13 and twist-sleeve 11 in different stages of turning the key in the lock.

Figure 3A:
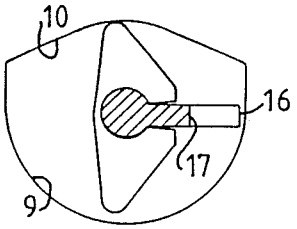
FIGS. 3A–3F illustrate schematically the state of the lock during mutually different key-turning stages.

In FIG. 3A the key, and therewith also the scraping device 11, has been turned one quarter of a revolution from the position shown in FIG. 1, i.e. to the position in which, in conventional lever tumbler locks, the outermost cam 16 of the key bit has begun to lift a corresponding tumbler. As will be seen from FIG. 3A, however, the tumblers are displaced upwards to a maximum by the scraping device 11 in this position of the lock.

Figure 3B:
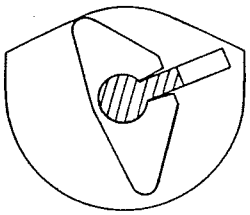

Further rotation of the key will cause the tumblers to be moved downwards by the force exerted by respective springs 12, until each tumbler is captured by a corresponding cam on the key bit. FIG. 3B illustrates the state of the lock immediately before the outermost cam 16 of the key bit engages its associated tumbler.

Figure 3C:
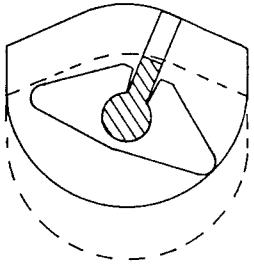

All tumblers will therefore be captured by their respective cams on the key bit, as the key is rotated between the positions shown in FIGS. 3B and 3C. In addition to showing the tumbler co-acting with the outermost cam 16 on the key bit, FIG. 3C also shows in broken lines the tumbler which co-acts with the innermost cam 17 on the key bit. FIG. 3C also shows the position in which the key bit comes into abutment with a guide surface of an auxiliary link on the link mechanism 6. In order for the auxiliary link, and therewith the bolt 5, to be displaced, it is necessary that the horizontal part of the tumbler channel 8 of each tumbler lies opposite the stop pin 7 and that these tumbler positions are maintained during the whole of that part of the rotational movement of the key which results in linear displacement of the bolt and which in the FIG. 3 illustration corresponds to rotation of the key between the positions shown in FIGS. 3C and 3D. As will be seen from these two figures, the configuration of the scraping device 11 is such that the scraping device will not contact any of the tumblers during this part of the key movement, and will not therefore obstruct linear displacement of the bolt.

Figure 3D:
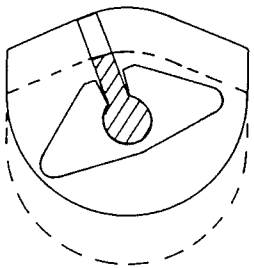
Figure 3E:
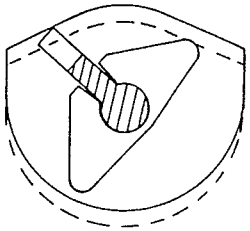
Figure 3F:
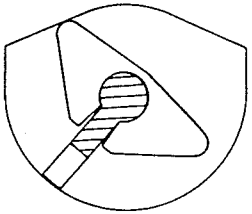

As the key is turned from the position shown in FIG. 3D, the scraping device 11 will first lift the tumbler which co-acts with the innermost cam 17 on the key bit and thereafter each of the remaining tumblers in sequence, all tumblers therefore being carried by the scraping device during the final movement of the key.

The aforedescribed sequences take place in the reverse order, when the lock is released.

It will thus be seen that one wing of the scraping device will precede the key bit as the key is turned in the lock and scrape against the tumblers. The other wing trails the key bit and the scrape marks produced thereby will cover the scrape marks produced by the innermost cams of the key bit, which can easily be understood from the illustrations of FIGS. 3C and 3D, which show the beginning and the end of the scrape marks produced by the innermost cam of the key bit.

Thus, the preferred embodiment of the invention will always ensure that the scrape marks caused by the innermost cams of the key bit will be covered by the scrape marks caused by the wing of the scraping device which trails behind the key bit. This is not completely necessary, however, since the individual scrape marks caused by the key bit as the key is turned cannot be distinguished from the scrape marks caused by a scraping device which consists solely of one wing which precedes the key bit when the key is turned in one direction and trails behind the key bit when the key is turned in the other direction.

Thus, the invention provides a simple and uncomplicated solution to the problem of preventing a burglar from obtaining sufficient information concerning the configuration of the key bit by reading the scrape marks on the tumblers. Those small scrape marks which might possibly be caused by the key bit and which can be detected on the tumblers despite the provision of the scraping device, are collected, as a result of the scraping device, within a much smaller contact area on respective tumblers for cams of differing heights on the key bit, and are therefore difficult to read. The inventive scraping device also makes it difficult to read these scrape marks due to the fact that the scraping device must be turned in order to be able to see the cam surfaces of respective tumblers, which is difficult to accomplish with present day burglary techniques. The invention also affords the advantage of being readily applied in existing locks, essentially without needing to modify the lock construction to any great extent. In conclusion, it will be seen that the combination of the solution afforded by this invention and the solution afforded by the invention defined in SE-B-8601831-4 will provide a lever tumbler lock in which the scrape marks provide no information whatsoever of the configuration of corresponding parts of the key bit.

Figure 4:
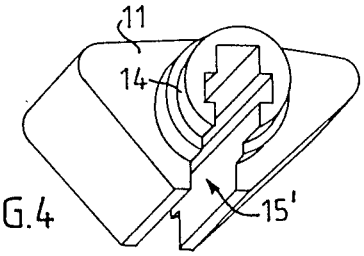
FIG. 4 is a view similar to FIG. 2 illustrating a modified scraping device.

In the case of the variant illustrated in FIG. 4, the channel 15' in the scraping device has solely flat walls and therewith co-acts with a flat key bit. Furthermore, the key stem and the channel are provided with mutually complementary projections and recesses or cuts, which renders copying of the key still more difficult.

It will be understood that a number of modifications can be made within the scope of the invention. As beforementioned, the scraping device may have only one wing and may also have configurations different to that described. The scope of the invention shall therefore be restricted solely by the contents of the following claims.

I claim:

1. A lever tumbler lock of the kind which includes a plurality of tumblers (2) which are displaceably mounted in a lock housing (1); a lock bolt (5) which, through the intermediary of a link arm mechanism 6 which is actuable by a key bit (13) can be displaced perpendicularly to the displacement direction of the tumblers between a first position, in which the bolt (5) projects from the housing (1), and a second position, in which the bolt is located fully within the housing; and a stop pin (7) which co-acts with the tumblers (2) in a manner to prevent movement of the bolt (5) when not all of the tumblers (2) have been displaced to their respective determined positions, displacement of respective tumblers (2) being effected responsive to the rotation of a key bit (13) inserted into a keyhole provided in the lock housing (1), said key bit during part of one revolution of the key co-acting with a cam surface (10) on respective tumblers in a manner to hold said tumblers in their determined positions for displacement of the bolt (5), and in which lock scrape marks caused by the key bit as it displaces the various tumblers will not divulge complete information concerning the configuration of the key bit, characterized by a device (11) which when a key bit (13) inserted in the lock housing (1) is turned will scrape against at least a part of the cam surface (10) of at least one tumbler (2) such as to produce on said cam surface (10) or cam surfaces (10) scrape marks which cover the scrape marks caused by corresponding cams (16, 17) on the key bit when the key is turned in the lock, at least at the beginning and the end of said scrape marks caused by said key bit.

2. A lock according to claim 1, characterized in that the scraping device has the form of a twist-sleeve (11) which is journalled for rotation in the lock housing (1) about a rotational axis which coincides with the rotational axis of the key, and which incorporates a channel (15) into which the lock key fits.

3. A lock according to claim 2, characterized in that the twist-sleeve (11) generally has a triangular configuration; in that the base surface faces towards the cam surfaces (10) of the tumblers (2); and in that the channel (15) in the twist-sleeve opens into the apex of the triangular twist-sleeve.

4. A lock according to claim 3, characterized in that the twist-sleeve (11) has the general shape of an isosceles triangle.

5. A lock according to claim 2, characterized in that the twist-sleeve channel (15) is keyhole shaped.

6. A lock according to claim 2, characterized in that the twist-sleeve channel has a rectangular cross-sectional shape.

7. A lock according to claim 6, characterized in that the twist-sleeve channel includes projections and recesses which prevents a key which does not have corresponding recesses and projections from being inserted into the lock.

* * * * *